United States Patent [19]

Okazaki et al.

[11] Patent Number: 5,059,097

[45] Date of Patent: Oct. 22, 1991

[54] VARIABLE CAPACITY WOBBLE PLATE COMPRESSOR

[75] Inventors: Michio Okazaki; Mototaka Shitara; Kenji Kosaka, all of Saitama, Japan

[73] Assignee: Diesel Kiki Co. Ltd., Tokyo, Japan

[21] Appl. No.: 469,047

[22] Filed: Jan. 23, 1990

[30] Foreign Application Priority Data

Jan. 26, 1989 [JP] Japan ..... 1-17063
Feb. 2, 1989 [JP] Japan ..... 1-10825[U]
Nov. 30, 1989 [JP] Japan ..... 1-311252

[51] Int. Cl.[5] ..... F04B 1/26
[52] U.S. Cl. ..... 417/222 S; 417/222 R
[58] Field of Search ..... 417/222, 222 S

[56] References Cited

U.S. PATENT DOCUMENTS 4,236,422 12/1980 Cochran ..... 417/222
4,617,797 10/1986 Williams ..... 417/222
4,737,079 4/1988 Kurosawa ..... 417/222 S
4,747,753 5/1988 Taguchi ..... 417/222 S
4,880,356 11/1989 Suzuki ..... 417/53
4,946,350 8/1990 Suzuki ..... 417/222

*Primary Examiner*—Richard A. Bertsch
*Assistant Examiner*—Peter Kurytnyk
*Attorney, Agent, or Firm*—Kanesaka & Takeuchi

[57] ABSTRACT

A variable capacity wobble plate compressor includes a wobble plate (36) in the crank chamber (7) for adjusting the piston stroke; a control valve (45) for controlling the chamber pressure in the crank chamber to adjust the angle of the wobble plate; a pressure sensor (53); a rotary speed sensor (56); a heat load sensor (61); and/or a vibration sensor (62); and a control unit responsive to a signal from at least one of the sensors for controlling the control valve to prevent the compressor from entering an unstable zone.

6 Claims, 9 Drawing Sheets

VARIABLE CAPACITY WOBBLE PLATE COMPRESSOR

BACKGROUND OF THE INVENTION

1. Field of the Invention

The present invention relates to variable capacity wobble plate compressors having a compression capacity regulated by the variable angle of the wobble plate.

2. Description of the Prior Art

Variable capacity wobble plate compressors, the piston stroke of which is changed by adjusting the angle of the wobble plate to regulate the compression capacity, are well known. In such compressors, the angle of the wobble plate with respect to the drive shaft changes as the drive shaft rotates. This wobble movement causes the piston to reciprocate so that the refrigerant is compressed and expanded within the associated cylinder. A control valve is placed in a passage between the crank chamber for housing the wobble plate and the suction chamber to control the degree of opening of the passage and thus the pressure of the crank chamber. This adjusts the angle of the wobble plate and thus the piston stroke, thereby regulating the compression capacity.

As FIG. 9 shows, however, such variable capacity wobble plate compressors have an unstable (surging) zone U defined by a characteristic curve of the discharge pressure Pd ($kg/cm^2G$) as a function of the rotary speed (rpm) of the compressor. The hatched unstable area, where both the discharge pressure and the suction pressure become unstable, varies with the heat load (evaporator load) and the exciting current through the pressure regulating valve as described below.

For example, three characteristic curves are given in FIG. 10 for three different heat loads A, B, and C ($A>B>C$) while five characteristic curves are given in FIG. 11 for five different exciting currents D, E, F, G, and H ($D<E<F<G<H$). The characteristic curve D indicates that the piston has a full stroke at zero ampere. In these unstable zones, abnormal vibrations take place, making it impossible to control the angle of a wobble plate, and continuous operation can damage the compressor.

SUMMARY OF THE INVENTION

Accordingly, it is an object of the invention to provide a variable capacity wobble plate compressor which is able to detect that the compressor is going into an unstable zone and prevent it from entering the unstable zone.

According to an aspect of the invention there is provided a variable capacity wobble plate compressor which includes a wobble plate provided within a crank chamber for adjusting a piston stroke; a control valve for controlling the chamber pressure of the crank chamber to adjust the angle of the wobble plate, thereby regulating the compression capacity of the compressor; a pressure sensor for detecting a pressure to provide a detection signal; and a control unit for determining whether the compressor is in an unstable zone on the basis of the detection signal and reducing the compression capacity when it is determined that the compressor is in the unstable zone.

According to another aspect of the invention there is provided a variable capacity wobble plate compressor which includes a wobble plate provided within a crank chamber for adjusting a piston stroke; a control valve for controlling the chamber pressure in the crank chamber to adjust the angle of the wobble plate, thereby regulating the compression capacity of the compressor; a rotary speed sensor for detecting the rotary speed of the compressor; a discharge pressure sensor for detecting a discharge pressure; and a heat load sensor for detecting a heat load so that when at least one of these sensors provides a value which exceeds a predetermined value, the control valve maintains the chamber pressure at a constant level, thereby maintaining the piston stroke constant.

According to still another aspect of the invention there is provided a variable capacity wobble plate compressor which includes a wobble plate provided within a crank chamber for adjusting a piston stroke; a control valve for controlling the chamber pressure in the crank chamber to adjust the angle of the wobble plate, thereby regulating the compression capacity of the compressor; a vibration sensor for detecting a vibration of the compressor; a reference selector for selecting a reference value corresponding to an unstable zone; a comparator for comparing the detected value with the reference value; and a drive circuit for controlling the exciting current to the control valve so that the compressor is brought to a stable zone from the unstable zone when the detected value exceeds the reference value in the comparator.

DESCRIPTION OF THE PREFERRED EMBODIMENT

Figure 1:
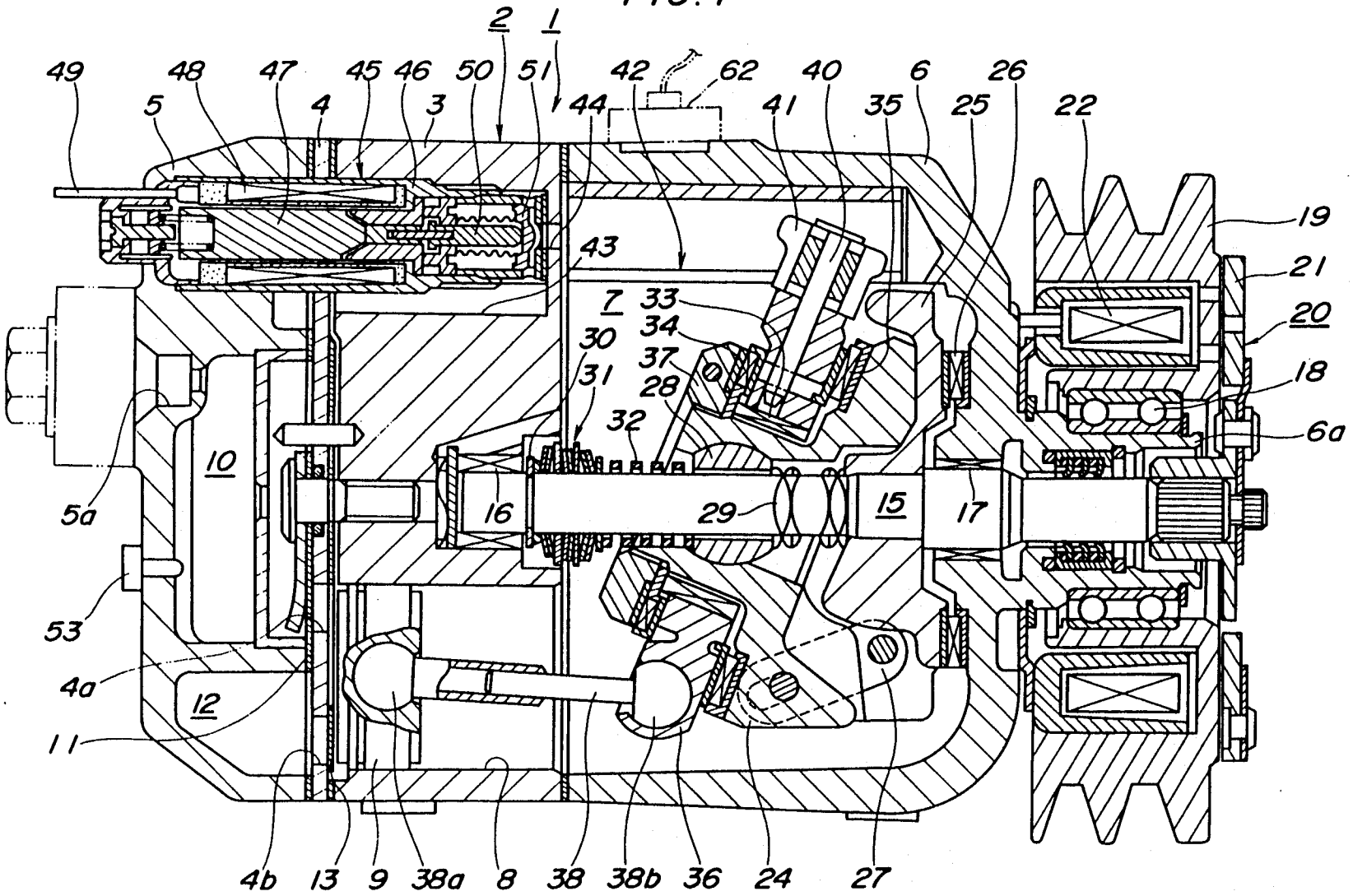
FIG. 1 is a longitudinal section of a variable capacity wobble plate compressor according to an embodiment of the invention.

In FIG. 1, a variable capacity wobble plate compressor 1 includes a housing 2 which consists of a cylinder block 3, a rear head 5 mounted on an end of the cylinder block 3 in airtight fashion through a valve plate 4 and a front head 6 mounted on the other end of the cylinder block 3 in airtight fashion for defining a crank chamber 7. The cylinder block 3 has a number of cylinders 8 circumferentially spaced at angular intervals and a number of pistons 9 fitted in the cylinders, one for each cylinder, for sliding motion.

The rear head 5 has a discharge port 5*a* on the end wall which defines a discharge chamber 10. The valve plate 4 has an outlet port 4*a* which connects the cylinders 8 to the discharge chamber 10. The opening of the outlet port 4*a* is controlled by a discharge valve 11. The discharge chamber 10 is surrounded by a suction chamber 12 which communicates with the cylinders 8 via an inlet port 4*b* of the valve plate 4. The opening of the inlet port 4*b* is controlled by a suction valve 13. The suction chamber 12 is connected to the outlet of an evaporator for an air conditioner while the discharge chamber 10 is connected to the inlet of a condenser via the discharge port 5*a*.

A drive shaft 15 is supported substantially on the center line of the housing 2 by a pair of bearings 16 and 17 for rotation. An end portion of the drive shaft 15 extends into a cylindrical projection 6*a* of the front head 6, on which a pulley 19 is mounted via a bearing 18 for rotation. The pulley 19 is coupled with the engine of a vehicle via a drive belt. An electromagnetic clutch 20 is placed between the pulley 19 and the drive shaft 15. It includes a clutch plate 21 secured to the drive shaft 15 so as to adjacent a side of the pulley 19 and an exciting coil 22 secured to the front head 6 so as to be placed within the pulley 19. Thus, when the exciting coil 22 is energized, the clutch plate 21 is attracted to the pulley 19 so that the rotation of the engine is transmitted to the drive shaft 15.

A rotary support 25 is fitted over the drive shaft 15 within the crank chamber 7 to transmit the rotation of the drive shaft 15 to the wobble plate mount 24. It is supported by a thrust bearing 26 which is secured to the front head 6. The wobble plate mount 24 is coupled with the rotary support 25 with a link arm 27 for rotation.

The wobble plate mount 24 is in sliding contact with the surface of a hinge ball 28 which is loosely fitted over the drive shaft 15 for sliding movement in the axial direction of the drive shaft 15. The driver shaft 15 carries a corrugated leaf spring 29 between the hinge ball 28 and the rotary support 25 so that the hinge ball 28 is biased toward the cylinder block 3. It also has a stopper 30 adjacent the cylinder block 3, and a number of leaf springs 31 and a coil spring 32 between the hinge ball 28 and the stopper 30 so that the hinge ball 28 is biased toward the front head 6.

A wobble plate 36 is mounted on the wobble plate mount 24 with a radial bearing 33 and a pair of thrust bearings 34 and 35 for rotation with respect to the wobble plate mount 24. The thrust bearings 34 and 35 are secured to the wobble plate mount 24 with a bearing holding plate 37. The front end of the wobble plate 36 and each piston 9 are coupled with a piston rod 38 which has a pair of balls 38*a* and 38*b* on opposite ends so that when the wobble plate 36 swings, the piston 9 reciprocates in the axial direction within the cylinder 8, thereby sucking and compressing the gaseous refrigerant.

The wobble plate 36 has a restraint pin 40 extending from a central portion to the outer end and a planar slipper 41 mounted on an end portion of the restraint pin 40 for rotation. A pair of guide plates 42 are placed within the front head 6 in the axial direction of the drive shaft 15 so that the restraint pin 40 and the planar slipper 41 move along a groove defined by the guide plates 42. Thus, when the drive shaft 15 rotates, the circumferential movement of the wobble plate 36 is restrained by the guide plates 42 so that the wobble plate 36 swings on the hinge ball 28 in the axial direction of the drive shaft 15.

There is provided a communication path 43 extending through the cylinder block 3, the valve plate 4, and the rear head 5. This path 43 communicates with the crank chamber 7 via a communication port 44 and the suction chamber 12 via a port (not shown) formed on the valve plate 4. A pressure regulation or control valve 45 is placed in the communication path 43. A plunger 47 is placed within a casing 46 of the pressure regulation valve 45 for axial movement. The control valve 45 has a solenoid 48 around the plunger 47 and a valve body 51 at the front end of an intermediate rod 50. A lead 49 is used to energize the solenoid 48. The amount of power supplied to the solenoid 48 is controlled to adjust the opening of the communication port 44, thereby changing the chamber pressure Pc in the crank chamber 7. This changes the angle of the wobble plate 36 with respect to the drive shaft 15, which in turn changes the stroke of the piston 9, thereby regulating the compression capacity within the cylinder 8. A discharge pressure sensor 53 is provided in the discharge chamber 10 to detect the discharge pressure Pd.

Figure 2:
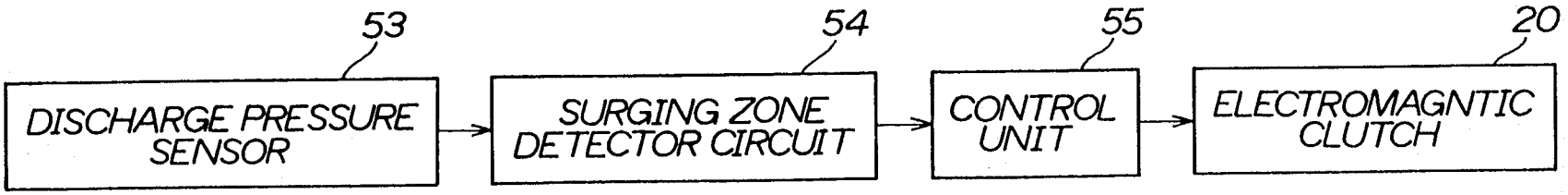
FIG. 2 is a block diagram of a control section of the variable capacity wobble plate compressor.
Figure 3:
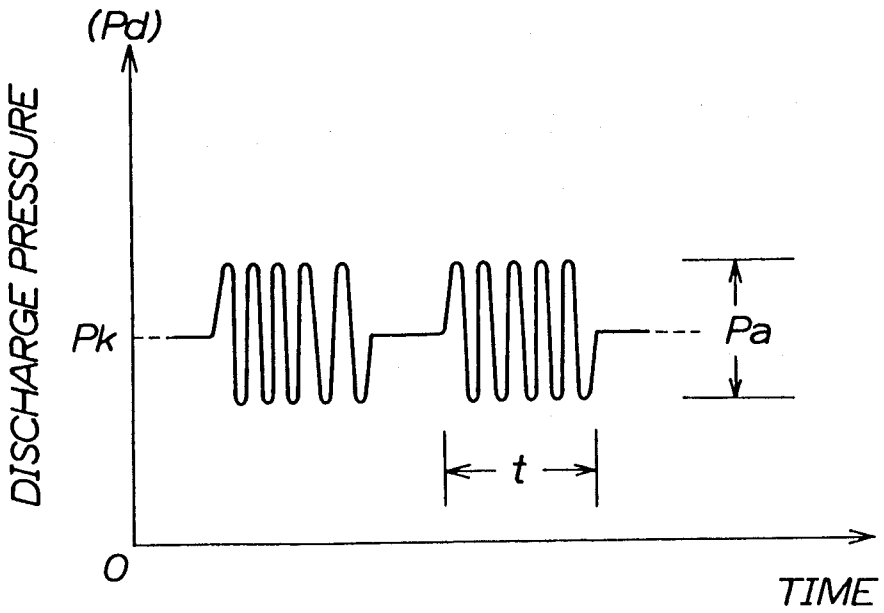
FIG. 3 is a waveform diagram of the discharge pressure which is fluctuating with the time.

As FIG. 2 shows, the discharge pressure sensor 53 is connected to a surging or unstable zone detector circuit 54 which detects an unstable zone on the basis of the discharge pressure Pd. The detector circuit 54 is connected to a control unit 55 which includes a drive circuit for turning off the electromagnetic clutch 20 when an unstable zone is detected. In the unstable zone, a sharp pressure fluctuation occurs. This is detected as a waveform which is pulsating around the constant discharge pressure Pk as illustrated in FIG. 3. On the basis of this detection signal, the detector circuit 54 detects an unstable zone. More specifically, the number of pulses (fluctuations), t, having an amplitude higher than a predetermined level P is preset and stored in the detector circuit 54. This preset waveform is compared with the detection signal from the discharge pressure sensor 53 to detect an unstable zone when the number of pulses in the detection signal is greater than that of the stored waveform.

Under light loads, the compressor 1 is controlled such that a high exciting current is supplied to the solenoid 48 of the control valve 45 so as to decrease the opening of the communication port 44. Consequently, the chamber pressure Pc of the crank chamber 7 increases, and the angle of the wobble plate 36 is decreased correspondingly to shorten the stroke of the piston 9, thereby decreasing the discharge capacity.

Under heavy loads, the compressor 1 is controlled such that the solenoid 48 is supplied with a low exciting current to increase the opening of the communication port 44 so that the chamber pressure Pc of the crank chamber 7 is decreased. Consequently, the angle of the wobble plate 36 is increased, thereby lengthening the piston stroke, resulting in the increased discharge capacity.

When the discharge pressure becomes unstable as the load increases, the discharge pressure sensor 53 detects a sharply fluctuating discharge pressure. When the detected number of fluctuations, t, of the discharge pressure Pd is greater than that of the preset waveform, the detector circuit 54 outputs an unstable zone detection signal to the control unit 55. In response to the detection signal, the control unit 55 deenergizes the exciting coil 22 of the electromagnetic clutch 20, thereby decoupling the clutch plate 21 from the pulley 19 so that the compressor 1 is no longer driven or is stabilized.

Now, the second embodiment of the invention will be described. This embodiment is characterized in that the electromagnetic clutch is turned off on the basis of both the discharge pressure and the rotary speed (rpm) of the compressor.

Figure 4:
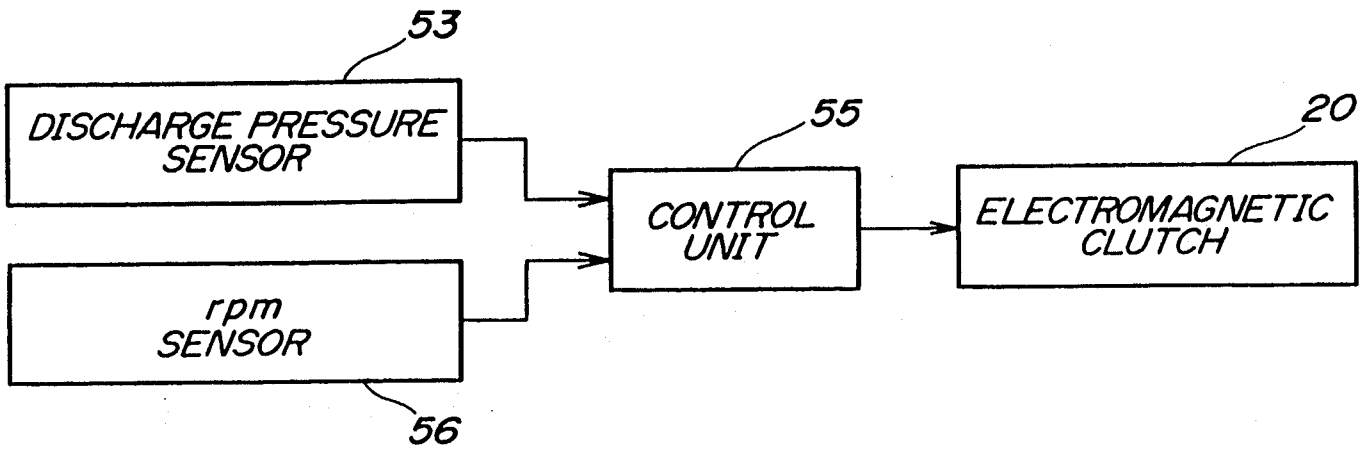
FIG. 4 is a block diagram of a control section of a variable capacity wobble plate compressor according to another embodiment of the invention.

As FIG. 4 shows, both the detection signal from the discharge pressure sensor 53 for detecting the discharge pressure Pd and the detection signal from a rotary speed sensor 56 for detecting the rotary speed N (rpm) of the compressor 1 are fed to the control unit 55. Based on these detection signals, the drive circuit of the control unit 55 turns on or off the electromagnetic clutch 20. Alternatively, the rotary speed N of the compressor 1 may be replaced with that of the engine.

Figure 5:
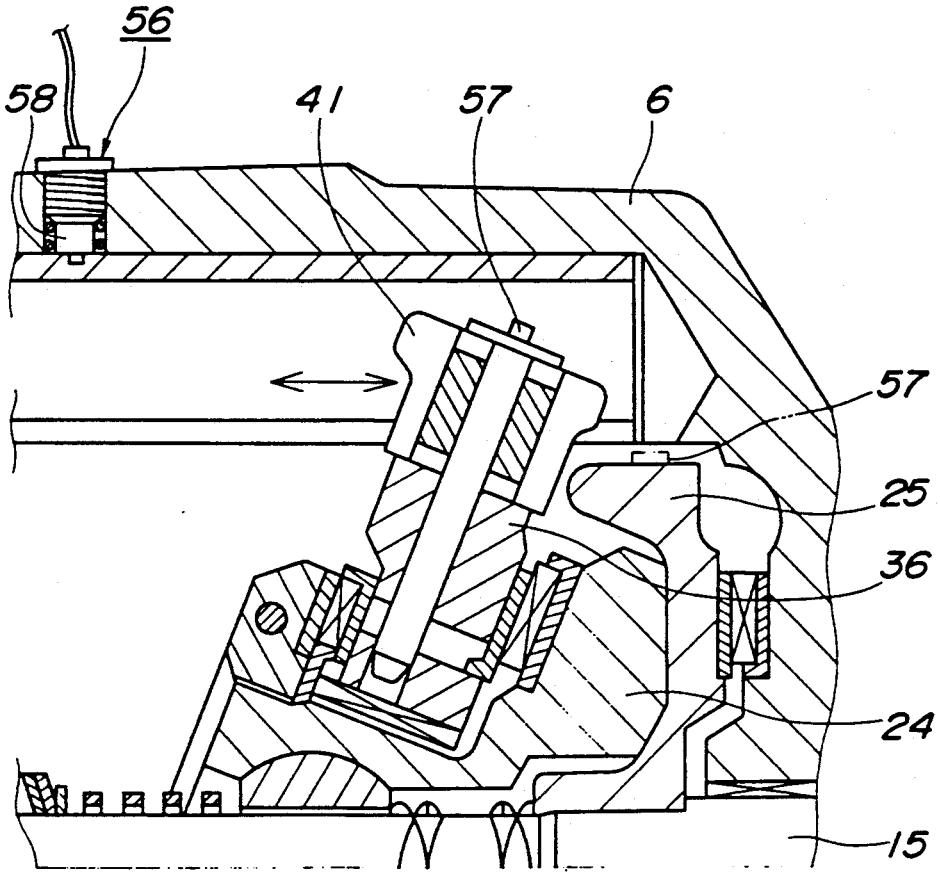
FIG. 5 is a longitudinal section of part of the variable capacity wobble plate compressor of FIG. 4.

As FIG. 5 shows, the rotary speed sensor 56 includes a magnet 57 mounted on the periphery of the planar slipper 41 for reciprocating movement in the axial direction of the drive shaft as indicated by an arrow and a magnetic sensor 58 mounted on the front head 6 such that the number of reciprocating movements of the planar slipper 41 is sensed to detect the rotary speed of the compressor 1. Alternatively, the magnet 57 may be placed on the periphery of the rotary support 25 as indicated by a two-dot chain line, and the magnetic sensor 58 may be mounted on the front head 6 such that it is opposed to the magnet 57.

In operation, unstable zones obtained from experiments are preset in the control section as discharge pressures Pd corresponding to rotary speeds N. When the discharge pressure Pd corresponding to the detected rotary speed N is in an unstable zone, the control unit 55 deenergizes the exciting coil 22 of the electromagnetic clutch 20, thereby bringing the compressor 1 to a stop. Consequently, the discharge capacity of the compressor 1 becomes zero, and the compressor 1 exits from the unstable zone.

Figure 6:
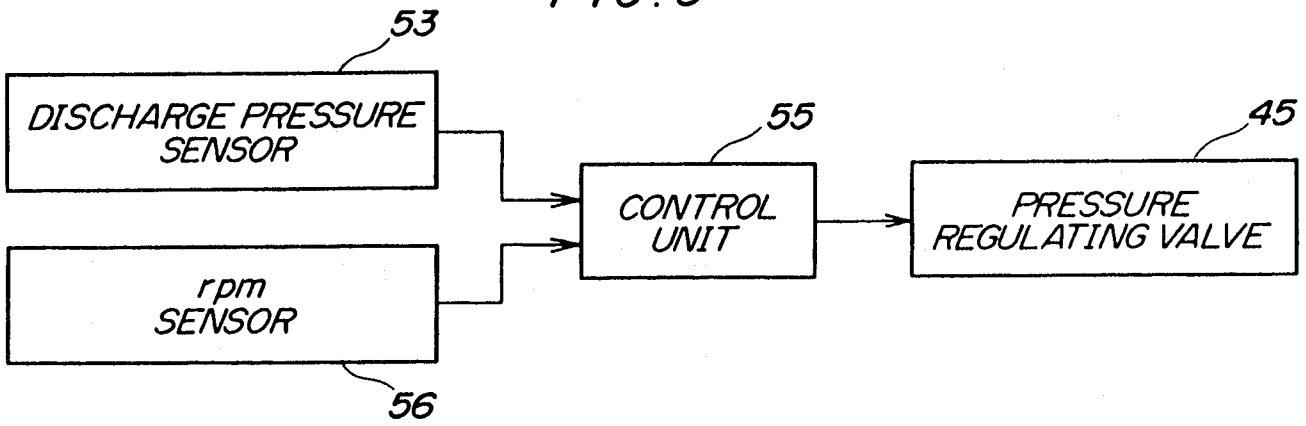
FIG. 6 is a block diagram of a variable capacity wobble plate compressor according to still another embodiment of the invention.

The third embodiment of the invention will now be described. As FIG. 6 shows, this embodiment is characterized in that the pressure regulation valve 45 is controlled to decrease the discharge pressure Pd on the basis of the discharge pressure (or suction pressure) and the rotary speed N (rpm).

With this embodiment, when the discharge pressure Pd detected by the pressure sensor 53 at the rotary speed detected by the rotary speed sensor 56 is in the preset unstable zone, the control unit 55 energizes the solenoid of the pressure regulation valve 45 with a high exciting current to decrease the opening of the communication port 44 so that the pressure of the crank chamber 7 is increased. As a result, the discharge pressure is lowered, enabling the compressor 1 to exit from the unstable zone and is stabilized.

In the above first through third embodiments, an unstable zone is detected on the basis of the discharge pressure, but it is possible to detect an unstable zone on the basis of the suction pressure because the suction pressure varies with the discharge pressure. Thus, when it is detected on the basis of the discharge or suction pressure sensed by the pressure sensor that the compressor 1 is entering an unstable zone, the discharge capacity of the compressor is brought to zero or reduced to such a level that the compressor exits from the unstable zone.

Figure 7:
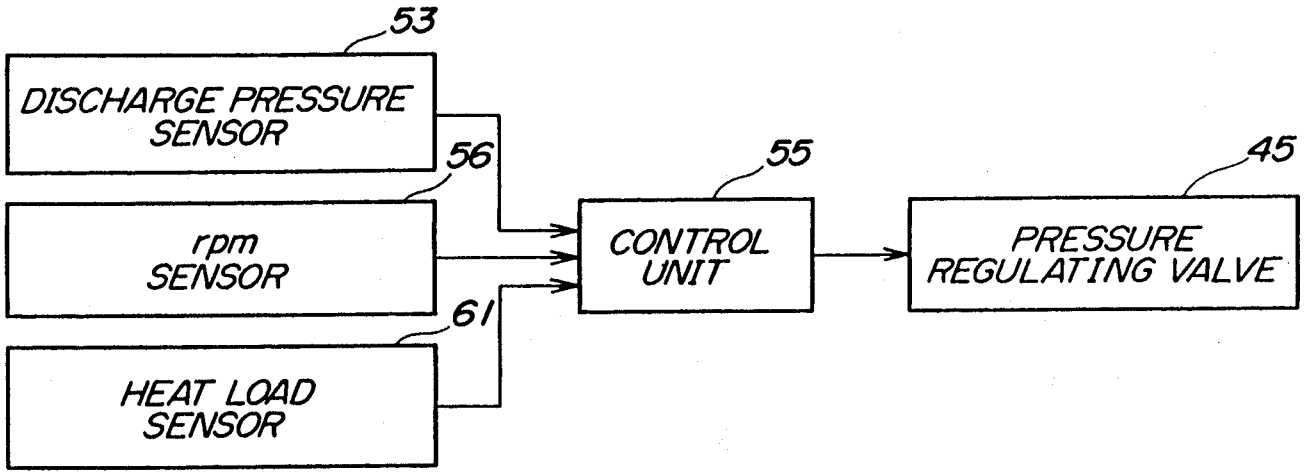
FIG. 7 is a block diagram of a variable capacity wobble plate compressor according to yet another embodiment of the invention.

The fourth embodiment of the invention will now be described. This embodiment is characterized in that the pressure regulation valve 45 is controlled on the basis of the discharge or suction pressure, the rotary speed, and the heat load as shown in FIG. 7. Respective detection signals from the discharge pressure sensor 53 for detecting the discharge pressure Pd, the rotary speed sensor 56 for detecting the rotary speed N of the compressor 1, and the heat load sensor 61 for detecting the heat load of an evaporator are fed to the control unit 55. The solenoid 48 of the pressure regulation valve 45 is connected to the drive circuit of the control unit 55. The discharge pressure sensor 53 and the rotary speed sensor 56 are mounted in the same manner as the above embodiments. The head load 61 is placed at a position upstream of the evaporator.

Under light loads, the compressor 1 is controlled such that the solenoid 48 of the pressure regulation valve 45 is energized with a high exciting current to decrease the opening of the communication port 44. Consequently, the chamber pressure Pc of the crank chamber 7 increases so that the angle of the wobble plate 36 decreases. As a result, the stroke of the piston 9 is shortened, thereby decreasing the discharge capacity.

Under heavy loads, the compressor 1 is controlled such that the solenoid 48 is energized with a low exciting current to increase the opening of the communication port 44. Consequently, the chamber pressure Pc of the crank chamber 7 is lowered so that the angle of the wobble plate 36 is increased, thereby increasing the piston stroke and thus the discharge capacity.

When the rotary speed N, the discharge pressure Pd, and the heat load exceed the predetermined values, respectively, during the control of the discharge capacity under heavy load conditions, the control of the discharge capacity is locked by keeping constant the current which flows through the solenoid of the pressure regulation valve 45. The respective boundary values of the rotary speed N, the discharge pressure Pd, and the head load for compressor to enter unstable zones, which were obtained from experiments, have been set in the control unit 55 as reference values. For example, if the rotary speed N detected by the rotary speed sensor 56, the discharge pressure Pd detected by the discharge pressure sensor 53, and the heat load or temperature Ta detected by the heat load sensor 61 exceed 500 rpm, 17 $kg/cm^2G$, and 35° C., respectively, with the compressor 1 driven continuously under such conditions, the compressor exceeds the preset reference values and enters the unstable zone. To prevent this, the current flowing through the solenoid of the pressure regulation valve 45 is kept constant at this point by controlling the current of the control unit 55. Thus, the opening of the communication port 44 and the chamber pressure Pc of the crank chamber 7 are kept constant. As a result, the angle of the wobble plate 36 is also kept constant, thereby preventing the piston stroke and the compression capacity from reaching such levels that the compressor 1 enters the unstable zone.

In the fourth embodiment, the piston stroke is held constant based on the detected rotary speed N, the discharged pressure Pd, and the heat load Ta, but it is possible to use only one of these parameters for making such control. The rotary speed N is most useful for effecting such control. When at least one of the rotary speed N, the discharge pressure Pd, and the heat load Ta exceeds a predetermined value, the chamber pressure of the crank chamber is held constant with the regulation valve 45 so that the piston stroke and thus the compression capacity are held constant, thereby preventing the compressor 1 from entering the unstable zone.

Figure 11:
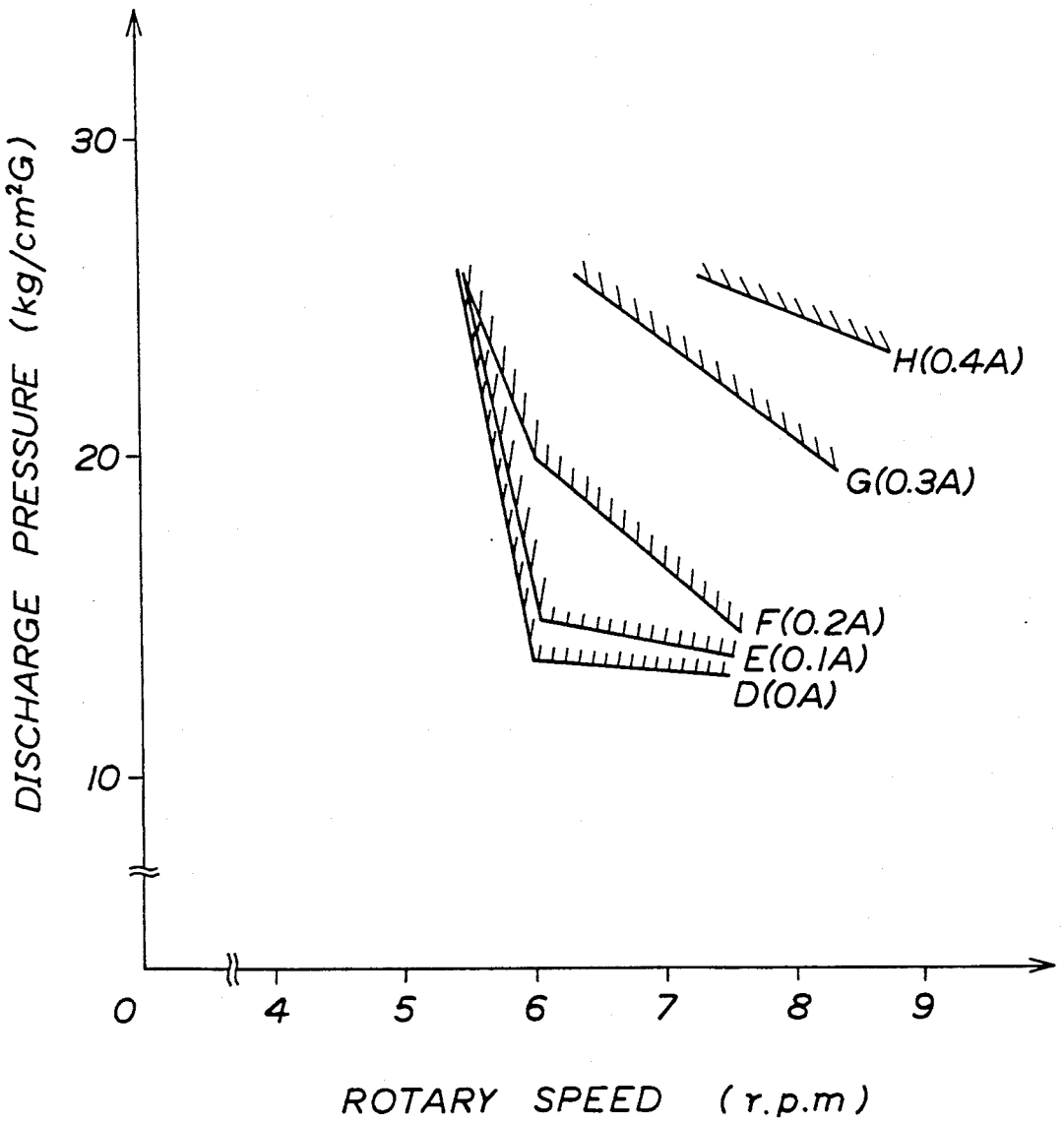

Finally, the fifth embodiment of the invention will be described. As FIG. 11 shows, the compressor 1 enters unstable zones depending on the intensity of exciting current supplied to the solenoid of the pressure regulation valve 45 for controlling the piston stroke. An abnormal vibration of the compressor 1 takes place in each unstable zone. In this embodiment, an abnormal vibration generated in the compressor is detected to control the exciting current to the solenoid of the pressure regulation valve 45.

Figure 8:
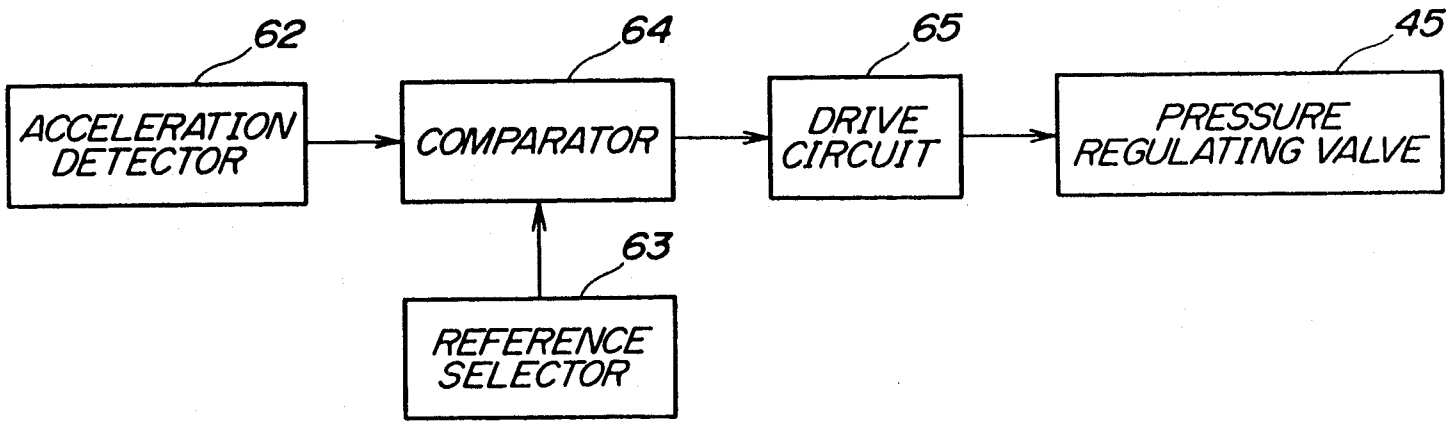
FIG. 8 is a block diagram of a variable capacity wobble plate compressor according to another embodiment of the invention.
Figure 9:
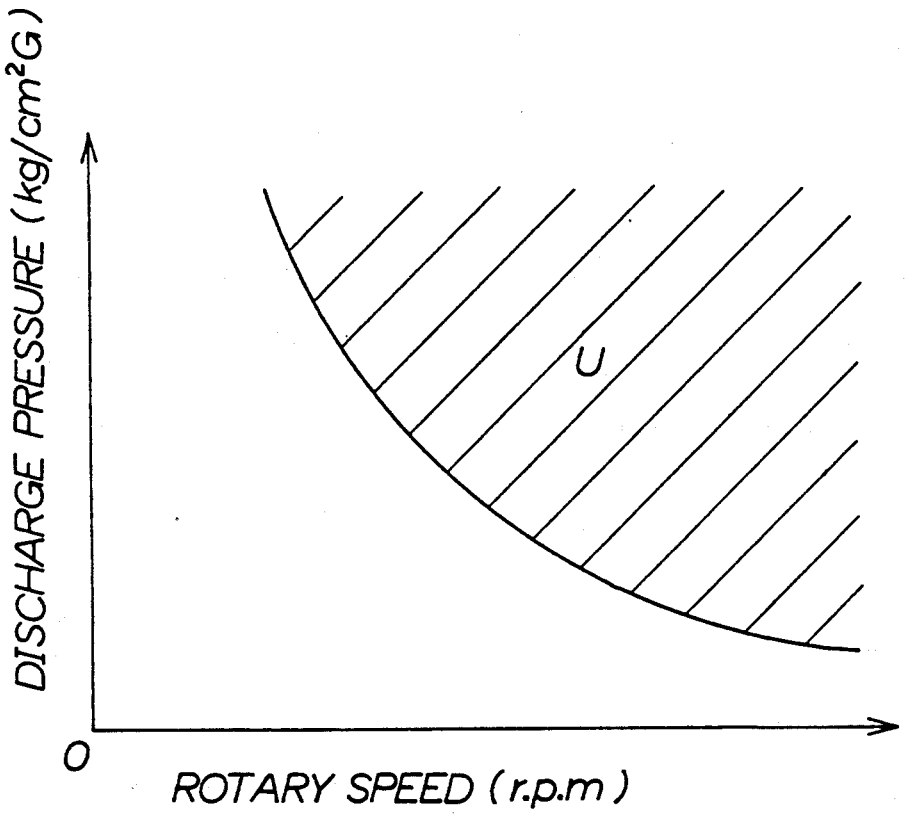
FIGS. 9–11 are graphs showing various characteristic curves of the discharge pressure ($kg/cm^2G$) vs. the rotary speed (rpm).
Figure 10:
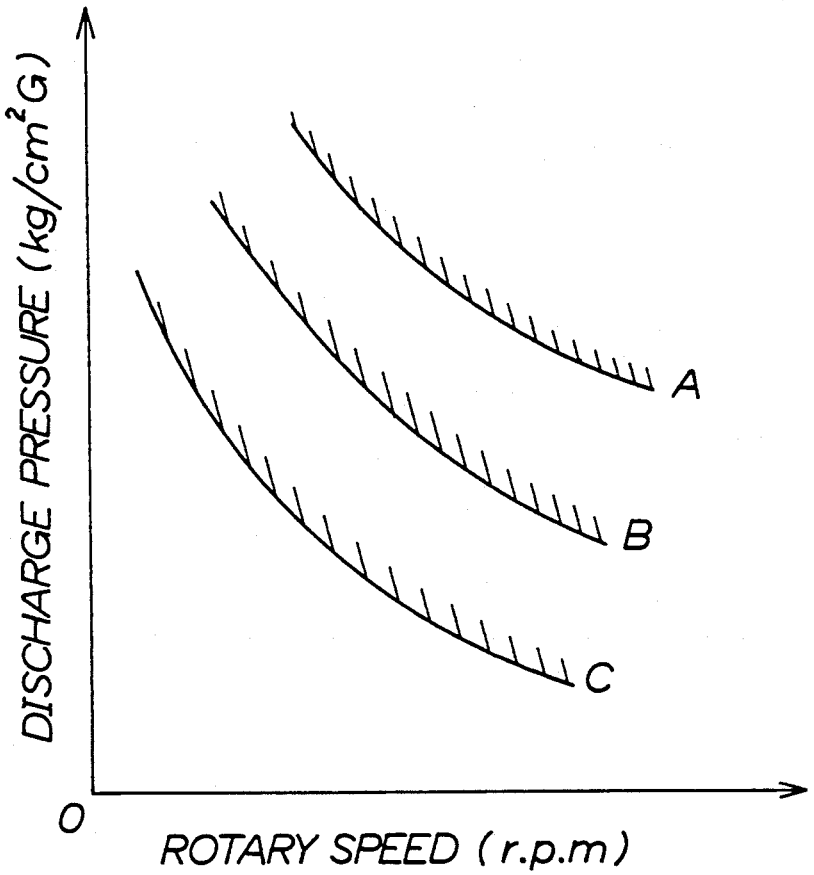

As FIG. 8 shows, the control section includes a vibration sensor 62 for detecting vibrations, a reference selector 62 for selection vibration reference values corresponding to unstable zones which have been obtained from experiments, a comparator 64 for comparing a detected vibration value with the reference value to determine whether the detected value exceeds the reference value, and a drive current 65 for controlling the exciting current to the solenoid 48 of the pressure regulation valve 45 so that when the detected value exceeds the reference value in the comparator 64, indicating that the compressor 1 is going into an unstable zone, control is made so that the compressor 1 is brought from the unstable zone to the stable zone.

The vibration sensor 62 includes a strain generator with a weight supported within a casing for generating a strain when it is subjected to an acceleration so that the weight is displaced with respect to the casing and a strain gauge for converting the strain into an electric signal. The vibration sensor 62 is secured to the housing 2 of the compressor 1, for example, as indicated by a two-dot chain line in FIG. 1.

When it is determined that the detected value of the vibration sensor 62 is abnormal in comparison with the preset reference value, the exciting current to the solenoid 48 is controlled so as to shorten the piston stroke, thereby brining the compressor 1 into the stable zone. Thus, the compressor 1 is protected against adverse effects of the vibration.

In the fifth embodiment, the exciting current to the solenoid 48 of the pressure regulation valve 45 is controlled on the basis of the abnormal vibration, but it is possible to turn off the electromagnetic clutch 20 to reduce the discharge pressure to zero as in the above first and second embodiment. Since the abnormal vibration tends to be generated during the idle rotation of the engine, it is especially useful to control the rotary speed of the engine during that period to protect the compressor against the abnormal vibration.

According to the fifth embodiment, in response to the detected value of vibration which exceeds the preset reference value, the exciting current to the solenoid of the regulation valve is controlled for changing the piston stroke, thereby bringing the compressor from the unstable zone to the stable zone.

What is claimed is:

1. A variable capacity wobble plate compressor comprising:

a wobble plate provided within a crank chamber for adjusting a piston stroke;

a control valve for controlling a chamber pressure within said crank chamber to adjust an angle of said wobble plate, thereby regulating a compression capacity of said compressor;

a vibration sensor for detecting a vibration of said compressor to provide a vibration signal;

a reference selector for selecting a vibration reference value corresponding to an unstable zone;

a comparator for comparing said vibration signal with said vibration reference value; and a drive circuit for controlling an exciting current to said control valve so that when said vibration signal exceeds said reference value in said comparator, said compressor is brought to a stable zone from said unstable zone.

2. A variable capacity wobble plate compressor comprising:

a wobble plate provided within a crank chamber for adjusting a piston stroke;

a control valve for controlling a chamber pressure within said crank chamber to adjust an angle of said wobble plate, thereby regulating a compression capacity of said compressor;

a pressure sensor for detecting a pressure to provide a detection signal; and control means for determining whether said compressor is in an unstable zone on the basis of said detection signal and reducing said compression capacity when it is determined that said compressor is in said unstable zone.

3. The variable capacity wobble plate compressor of claim 2, wherein said pressure sensor is a discharge pressure sensor mounted on a discharge chamber.

4. The variable capacity wobble plate compressor of claim 2, wherein said pressure sensor is a suction pressure sensor mounted on a suction chamber.

5. The variable capacity wobble plate compressor of claim 3, which further comprises a rotary speed sensor for detecting a rotary speed of said compressor so that when both of said detected discharge pressure and said rotary speed exceed predetermined values, said control valve maintains said chamber pressure of said crank chamber at a constant level, thereby keeping said piston stroke constant.

6. The variable capacity wobble plate compressor of claim 3, which further comprises a heat load sensor for detecting a heat load so that when both of said detected discharge pressure and said heat load exceed predetermined values, said control valve maintains said chamber pressure of said crank chamber at a constant level, thereby keeping said piston stroke constant.

* * * * *